US005425177A

United States Patent [19]

Pacenti

[11] Patent Number: 5,425,177

[45] Date of Patent: Jun. 20, 1995

[54] SIGHT DEVICE FOR AN ARCHERY BOW

[76] Inventor: James R. Pacenti, P.O. Box 121 Little Creek Rd., Martins Creek, Pa. 18063

[21] Appl. No.: 101,417

[22] Filed: Aug. 3, 1993

[51] Int. Cl.[6] ..... F41G 1/467; F41G 5/00

[52] U.S. Cl. ..... 33/265; 124/87

[58] Field of Search ..... 33/265, 252, 254, 261; 124/87

[56] References Cited

U.S. PATENT DOCUMENTS

| | | | |
|---|---|---|---|
| 3,670,422 | 6/1972 | Stebbins et al. | 33/265 |
| 3,766,656 | 10/1973 | Westphal | 33/265 |
| 3,910,700 | 10/1975 | Sprandel | 33/265 |
| 4,481,717 | 11/1984 | Kowalski | 33/265 |
| 4,543,728 | 10/1985 | Kowalski | 33/265 |
| 4,617,741 | 10/1986 | Bordeaux et al. | 33/265 |
| 4,753,528 | 6/1988 | Hines et al. | 33/265 |
| 4,910,874 | 3/1990 | Busch | 33/265 |
| 4,913,546 | 4/1990 | Nagaoka et al. | 356/1 |
| 5,040,301 | 8/1991 | Forbis | 33/265 |
| 5,072,716 | 12/1991 | Sappington | 33/265 |
| 5,103,568 | 4/1992 | Canoy | 33/265 |
| 5,165,178 | 11/1992 | Seely | 33/265 |

*Primary Examiner*—Christopher W. Fulton
*Attorney, Agent, or Firm*—Horst M. Kasper

[57] ABSTRACT

The bow sight device includes an electro-mechanical motor operated cross-hair sight for use with compound bows. The electro-mechanical motor operated cross-hair sight includes a sight window. A verticals, mechanically adjustable cross hair and a horizontal, motor-operated cross-hair are disposed within the sight window. A calibration of the cross hairs allows for a precise and quick adjustment of the intersection point in order to provide a dead center reference point.

17 Claims, 3 Drawing Sheets

SIGHT DEVICE FOR AN ARCHERY BOW

BACKGROUND OF THE INVENTION

1. Field of the Invention

The present invention relates to a sight adjustment device for an archery bow.

2. Brief Description of the Background of the Invention Including Prior Art

Kowalski teaches in the U.S. Pat. No. 4,481,717 an archery bow sight. Kowalski employs an elongated frame with a mounting plate for securing the frame to a bow above the arrow-receiving portion of the bow. The reference employs upper and lower flanges on the frame to support opposite ends of a threaded shaft which, at a top of the frame, is coupled with a pulley engaged with a belt coupled to a pulley on the shaft of a motor that is also mounted on the frame. The reference employs a lens with colored range markings as a sight assembly. This sight employs a lens, a pointer, a sliding block, a windage-adjustment shaft and a light, all of which are attached to the threaded shaft. An alignment of the sight to the target is achieved by raising or lowering the sight assembly in relationship to a color-coded lens, a lens pointer, an elevation pointer, and a scale.

The U.S. Pat. No. 4,543,728 to Kowalski also teaches an archery bow sight. The main differences between the Kowalski U.S. Pat. Nos. 4,481,717 and 4,543,728 are in that the U.S. Pat. No. 4,532,728 teaches a manually operated bow sight including a novel sighting pin support with a bulky, view-impeding sighting pin, whereas the U.S. Pat. No. 4,481,717 teaches a motor-operated bow sight including a very complicated color-coded lens.

The U.S. Pat. No. 3,766,656 to Westphal teaches a motor-driven bow sighting device. A single sighting pointer is adjustably movable vertically in registry with the sighting window on the bow. The sighting pointer is mounted on and extends laterally from a nut which is threadably received on a screw rotatably supported on a bracket. An electric switch for energizing the motor for raising or lowering the sight indicator is located on the bracket or in a convenient access location on the bow hand grip. The Westphal sighting device uses a threaded shaft and a motor.

The sight of the Westphal reference employs the use of a rear sight pointer, which is used in conjunction with a forward sight pointer to obtain alignment to the target. The yardage scale of the Westphal reference is on the opposite side of the bow riser and the sight is mounted flush on the front of the bow. The drive mechanism uses gears. The forward sight pointer is unprotected.

Bordeaux et al. in the U.S. Pat. No. 4,617,741 teach an electronic rangefinder for archery. The reference shows a range-finding window and a numerical yardage display to be seen an archer.

U.S. Pat. No. 4,753,528 to Hines et al. teaches a laser archery distance device. The reference feeds the laser light to a transmitting lens, reflects the laser light, collects the reflected laser light with a receive lens, and measures the reflective light impinged on photo detectors.

U.S. Pat. No. 4,913,546 to Nagaoka et al. teaches a range finder. An infrared light beam is projected to an object and the light beam reflected from the object is detected by a split photosensor.

U.S. Pat. No. 5,040,301 to Forbis teaches a rear bow sight. The rear bow sight includes a pair of spaced apart, parallel sighting line members mounted aft of the bow frame. The bow is position such that the target appears between the sighting lines.

SUMMARY OF THE INVENTION

1. Purposes of the Invention

It is an object of the present invention to provide a sight device for an archery bow which is convenient and easy to handle.

It is another object of the present invention to provide an archery bow sight device which is motor-operated and which allows an adjustment for the desired position.

These and other objects and advantages of the present invention will become evident from the description which follows.

2. Brief Description of the Invention

The sight or sighting device of the present invention gives an archer the ability to adjust the sight quickly and quietly for distances throughout a full spectrum of usable range. An optional attachment to the sight device can additionally be provided with an infrared sensing device and an associated electronic circuit that will automatically adjust the horizontal or elevation cross hair to a proper height level of the target.

The sight device of the invention uses a novel concept to achieve alignment. The sight device of the invention includes a use of very fine cross hairs and of a sight window. To obtain alignment it is only necessary to align the elevation cross hair with the yardage distance scale located on the left side of the sight window. The convergence of the elevation and vertical cross hairs forms a very clean and accurate alignment point. It is not necessary for an archer to lose sight of the target when making his adjustments since the yardage scale, cross hairs, and target are in perfect perspective due to the sight window.

The sight frame which forms the sight window and all of its components are attached to the extension bracket. This bracket extends the sight approximately 5 inches in the forward direction from the front of the bow. This front extension gives an archer a clear view of the sight window and the cross hairs and scale.

The vertical and elevation cross hairs, the threaded shaft, and collar, which lowers and raises the elevation cross hair, and a guide for the elevation cross hair, located on the inside of the left side of the window, are contained within the sight frame of the invention sight device. The guide for the elevation cross hair prevents the elevation cross hair from vibrating and experiencing a shock when the bow is fired. Furthermore, the guide for the elevation cross hair also allows for smooth adjustment of the cross hair.

The sight device of the present invention is belt driven.

The bow sight device according to the present invention includes a rectangular frame. A horizontally disposed, vertical-adjustment shaft is disposed at a first horizontal side of the rectangular frame. A horizontal retaining channel is disposed inside the rectangular frame and running parallel to and at a second horizontal side of the rectangular frame. A vertical cross hair is retained by the horizontal retaining channel and attached to a support element mounted at the vertical-adjustment shaft for the vertical cross hair. A vertical cross hair guide is disposed inside the rectangular frame and running parallel to and at a first vertical side of the rectangular frame. A a threaded shaft is disposed near a second vertical side of the rectangular frame. The first horizontal side of the rectangular frame supports a first side of the threaded shaft. The second horizontal side of the rectangular frame supports a second side of the threaded shaft. A shaft pulley is mounted to the threaded shaft outside the rectangular frame. A motor includes a motor shaft and is attached to the rectangular frame and has an axis parallel to the axis of the threaded shaft. A motor pulley is mounted on the motor shaft. A drive belt connects the motor pulley and the shaft pulley. A threaded collar is attached to the threaded shaft. A horizontal elevation cross hair is attached to the threaded collar and retained by the vertical cross hair guide.

A geographical location of a center position is established for a target by shooting a few arrows at a target. If it is determined that these arrows are hitting to the left of the target, then the vertical cross hair is moved in the bow sight device by adjustment to the left. If it is determined that these arrows are hitting to the right of the target, then the vertical hair is moved in the bow sight device by adjustment to the right. An adjustment collar retaining the vertical cross hair is locked once the center of the target as determined by the vertical cross-hair is established. A screw at the adjustment collar is tightened to hold the vertical cross hair stationary in its position. The distance yardage is adjusted by placing a stripe of white tape on the left side of the sight window. This tape will be used to mark the various distances. A distance of 20 yards is measured to the target. A few arrows are shot at the target. If the arrows are hitting at a point lower than anticipated, then the horizontal cross hair is lowered by pushing the switch for moving the horizontal cross hair. If the arrows are hitting at a point higher than anticipated, then the horizontal cross hair is raised by pushing the switch for moving the horizontal cross hair. Then it is determined whether the arrows hit an exact dead center of the target. A mark is placed on the white tape, where this mark represents a 20-yard mark. The preceding steps are repeated for adjusting the distance yardage for various distances selected.

The sight is adjustable quickly and quietly throughout the full spectrum of usable range with the sight device including the sight window. The sight window frames the target and the convergence of the cross hairs to provide a dead center reference point.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENTS

Figure 1:
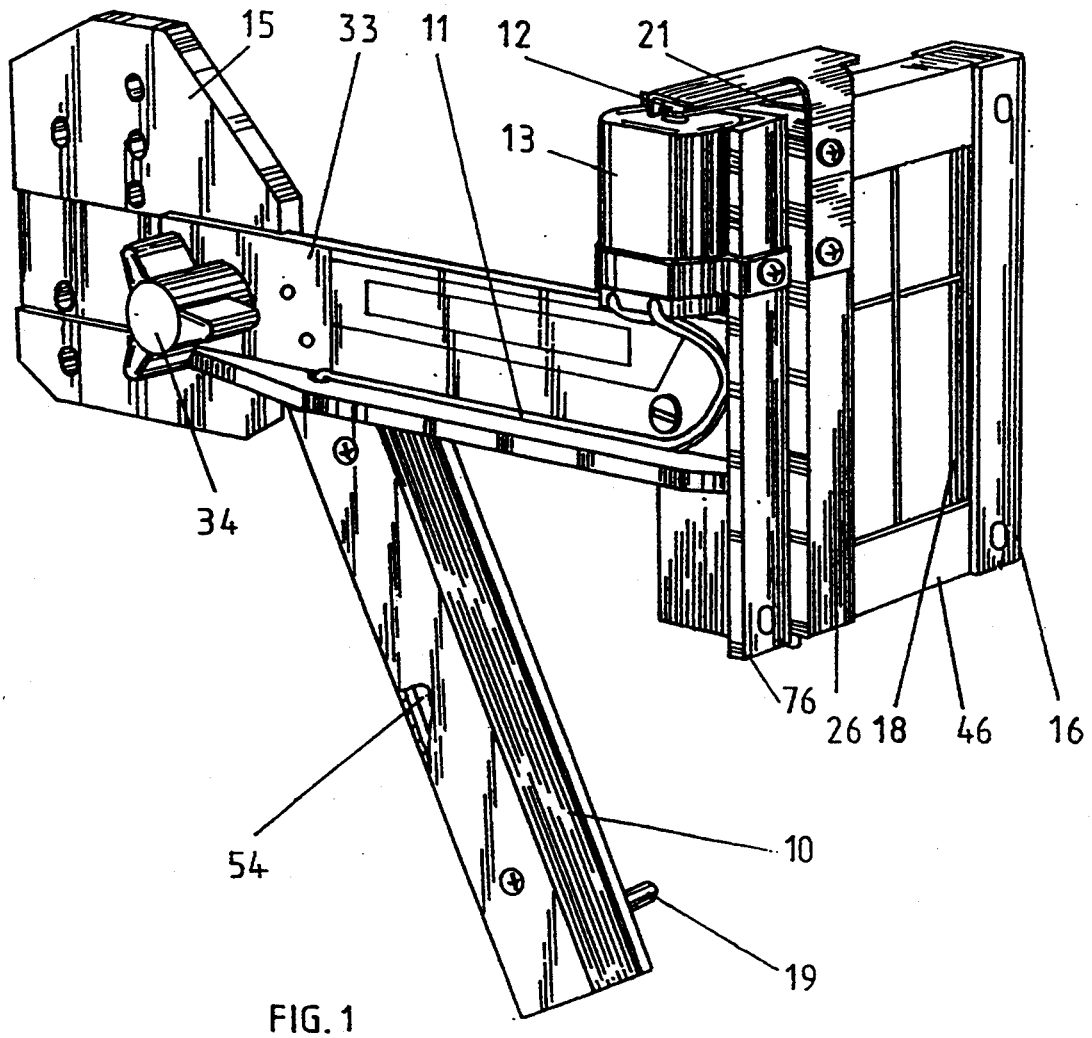
FIG. 1 is a rear perspective view of a sight device for a bow.
Figure 2:
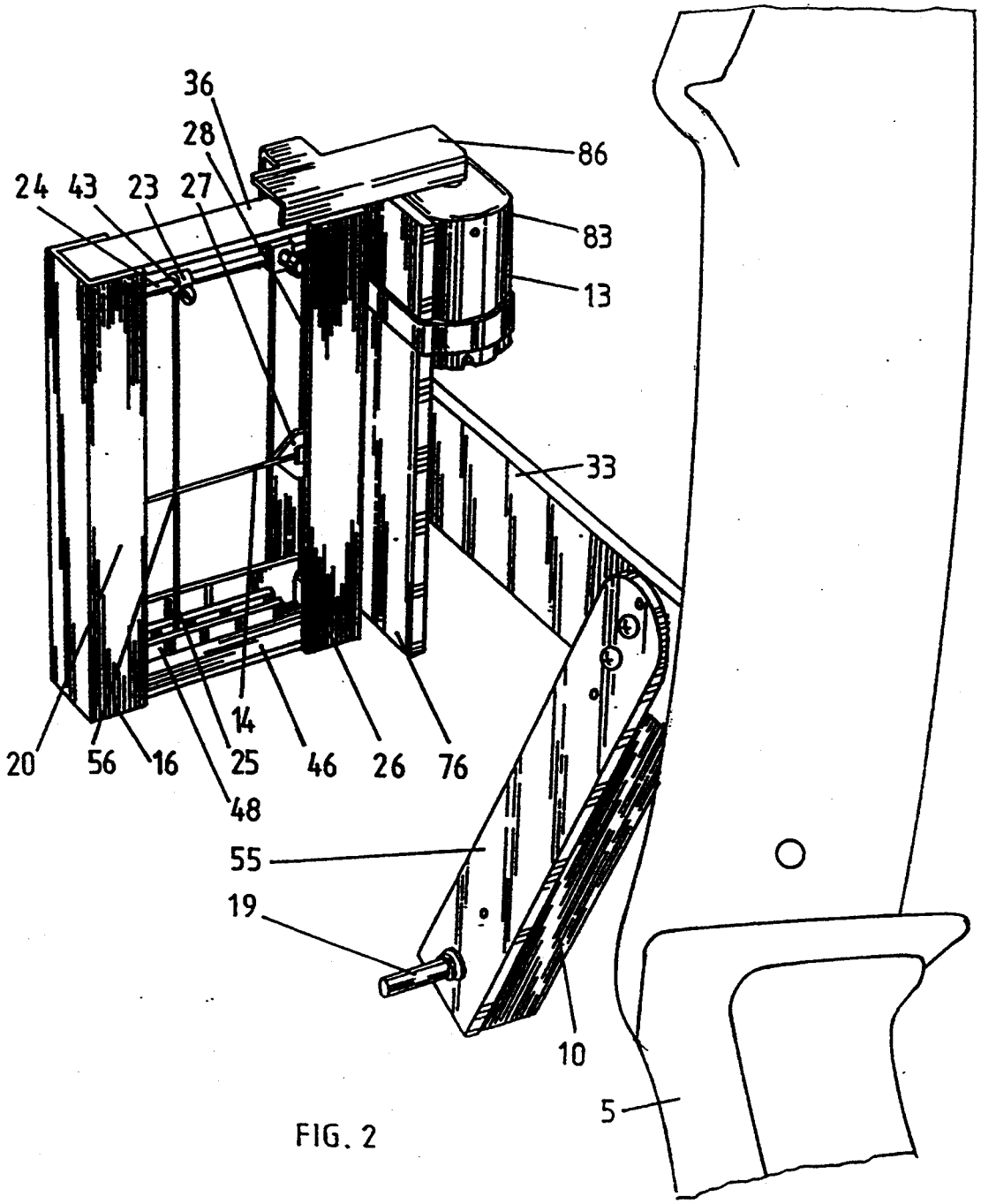
FIG. 2 is a front perspective view of the sight device for the bow of FIG. 1.

According to the present invention, there is provided for a bow sight device including a rectangular frame. A horizontally disposed, vertical-adjustment shaft 24 is disposed at a first horizontal side 36 of the rectangular frame. A horizontal retaining channel 48 is disposed inside the rectangular frame and running parallel to and at a second horizontal side 46 of the rectangular frame. A vertical cross hair 25 is retained by the horizontal retaining channel 48 and is attached to a support element 23 mounted at the vertical-adjustment shaft 24. A vertical cross hair guide 18 is disposed inside the rectangular frame and running parallel to and at a first vertical side 16 of the rectangular frame. A threaded shaft 28 is disposed near a second vertical side 26 of the rectangular frame. The first horizontal side of the rectangular frame supports a first side of the threaded shaft 28. The second horizontal side part of the rectangular frame supports a second side of the threaded shaft 28. A shaft pulley 22 is mounted to the threaded shaft 28 outside the rectangular frame. A motor 13 includes a motor shaft 77 and is attached to the rectangular frame and has an axis parallel to the axis of the threaded shaft 28. A motor pulley 12 is mounted on the motor shaft 77. A drive belt 21 connects the motor pulley 12 and the shaft pulley 22. A threaded collar 27 is attached to the threaded shaft 28. A horizontal elevation cross hair 14 is attached to the threaded collar 27 and is retained by the vertical cross hair guide 18.

A motor support bar 76 can be attached to the rectangular frame and can support the motor 13. A protective cover 86 can be attached to the rectangular frame and can cover the motor pulley 12, the shaft pulley 22, and the drive belt 21. An extension bracket 3.3 can be attached to the motor support bar 76. A switch support bar 55 can be attached to the extension bracket 33. An electrical switch 19 can be mounted on the switch support bar 55. A battery 54 can be disposed in a battery compartment 10. The battery compartment 10 can be attached to the switch support bar 55. The battery 54 can be connected to the electrical switch 19 for feeding electrical power to the motor 13 upon actuation of the electrical switch 19.

An electrical line 11 can connect the battery 54 to the motor 13.

The vertical cross hair 25 can be disposed at a close distance behind the horizontal elevation cross hair 14 toward an operator of the bow. A positioning of the vertical cross hair 25 and of the horizontal elevation cross hair 14 can form an intersection point 56 within the rectangular frame. The positioning of the vertical cross hair can be manually adjusted and the positioning of the horizontal elevation cross hair 14 can be adjusted with a moving of the shaft pulley 22 upon actuation of the electrical switch 19.

The vertical cross hair 25 and the horizontal elevation cross hair 14 can in each case be formed by a thin wire which is rigid enough to retain a straight direction.

The rectangular frame can form a sight window. The first horizontal side and the second horizontal side of the sight window can in each case be formed by angle irons. The first vertical side and the second vertical side can in each case be formed by U profiles.

The horizontal retaining channel and the vertical cross hair guide can in each case be formed by a U profile of a smaller size than the U profiles forming the first vertical side and the second vertical side.

The sight window can be disposed at such a distance from a bow 5 as to allow a most precise and steady shooting of an arrow to a target.

The distance from the sight window to the bow 5 can be from 5 to 10 inches and is preferably from 7 to 8 inches.

A mounting bracket 15 can be detachably fixed with a butterfly screw at the extension bracket 33.

The motor can cause a clockwise and a counterclockwise rotation of the motor shaft depending on the position of the electrical switch. The motor can be a two-speed motor.

A nylon bushing 96 can be disposed at the first side of the threaded shaft 28 and a nylon bushing 66 can be disposed at the second side of the threaded shaft 28. A retaining nut 17 fixedly secures the second side of the threaded shaft 28 to the second horizontal side 46 of the rectangular frame.

A distance between the motor support bar 76 and the second vertical side 26 of the rectangular frame is from about ¼ inch to ½ inch.

This invention sight device is an electromechanical motor-operated cross hair sight for use with compound bows. The elevation cross hair 14 can be used as both a range finder and yardage adjustment to help an archer to determine the distance to the target. The sight device of the present invention substantially provides a sight frame which comprises a first side wall 16, a second side wall 26, a top bar 36, and a bottom bar 46. The first side wall 16 and the second side wall 26 have the shape of a U and are disposed such that the inner areas of the U shapes of the first side wall 16 and of the second side wall 26 face each other. The first side wall 16 and the second side wall 26 are joined together by the horizontal top bar 36 and the horizontal bottom bar 46 such that the first side wall 16, the bottom bar 46, the second side wall 26, and the top bar 36 form the rectangular sight frame. The bottom bar 46 and the top bar 36 are dimensioned such as to fit into the U shape of the first side wall 16 and of the second side wall 26, where the U shape appears in a horizontal cross-section in axial direction through the side walls 16, 26. The first side wall 16 and the second side wall 26 are preferably furnished by a profile iron. The sight position is defined by a horizontally disposed motor-operated elevation cross hair 14 and by a vertical cross hair 25. The position of the motor-operated elevation cross hair 14 is easily adjustable, whereas the vertical cross hair 25 is placed into a defined position. The vertical cross hair 25 is held by an adjustment collar 23 for the vertical cross hair 25 at the top of the sight frame.

The invention sight device is associated with the advantage that it uses fine cross hairs 14, 25 to converge on the target. Alignment is achieved at the intersection of vertical and elevation cross hairs. The distance scale on the sight device of the present invention is located on the first side wall of the sight window. The sight device of the present invention further is mounted forwardly of the bow riser. The elevation cross hair 14 of the sight device of the invention is belt driven. A frame, which was referred to as a sight window, protects the cross hairs 14, 25 from external interference.

The vertical cross hair 25 is retained in its position at the bottom of the sight frame by a horizontal channel 48. The horizontal channel 48 runs parallel to the bottom bar 46 and is preferably formed in the bottom bar 46. The horizontal channel 48 is made of such a depth that, under normal conditions, the vertical cross hair 25 will be retained in the horizontal channel 48. Alternatively, it is possible, if desired, to bend the vertical cross hair 25 and thereby to move the vertical cross hair 25 out of the horizontal channel 48.

The adjustment collar 23 for the vertical cross hair 25 is mounted on a vertical-adjustment shaft 24. The vertical cross hair 25 is attached to the locking adjustment collar 23 that slides on the horizontally disposed smooth vertical-adjustment shaft 24 which is mounted inside of and at the top of the sight frame. The vertical cross hair is locked in place after the archer establishes the geographical center of the target.

The vertical-adjustment shaft 24 is preferably mounted to the first side wall 16 and to the second side wall 26 to provide a defined position for the vertical-adjustment shaft 24. The vertical-adjustment shaft 24 allows the adjustment collar 23 for the vertical cross hair 25 to be positioned in any desired position between the first side wall 16 and the second side wall 26. Preferably, a set screw 43 is provided at the adjustment collar 23 for the vertical cross hair 25 such that the adjustment collar 23 for the vertical cross hair 25 can be fixed in a defined position at the vertical-adjustment shaft 24.

The position of the vertical-adjustment shaft 24 is substantially centered with respect to the U shape of the top bar 36 such as to provide the vertical cross hair 25 about in the center of the sight frame.

The elevation cross hair 14 is disposed close to the vertical cross hair 25 such that the person viewing the vertical cross hair and the elevation cross hair 14 essentially view an intersection point 56 of the two cross hairs 14, 25. The vertical cross hair 25 and the elevation cross hair 14 are preferably formed from fine but relatively rigid wires which will retain a straight direction. The wires can be covered with a jacket of plastic and such jacket can have a color such as red and yellow which will distinguish the vertical cross hair 25 and the elevation cross hair 14 from the field of view being seen by the hunter.

Figure 3:
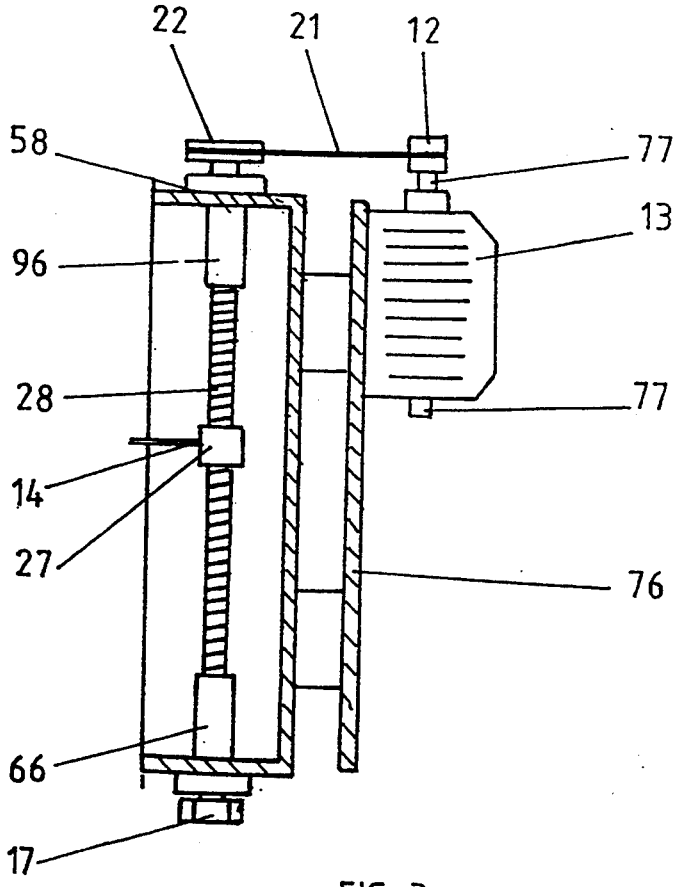
FIG. 3 is an isometric view showing a drive mechanism for the elevation cross hair.
Figure 4:
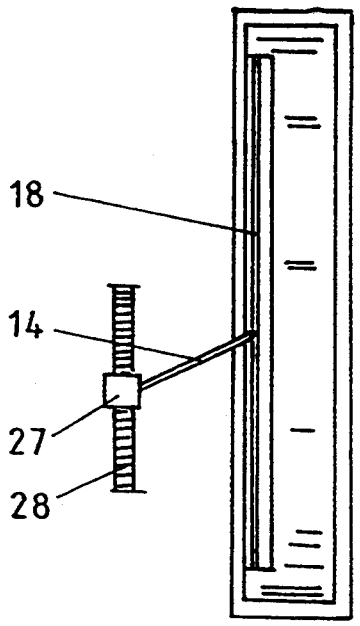
FIG. 4 is a schematic diagram illustrating an elevation cross hair and its guide and supporting mechanism.

The elevation cross hair 14 is guided by a cross hair guide 18 (FIG. 1) which is formed and disposed within the U shape of the first side wall 16. The elevation cross hair 14 is attached to a threaded collar 27. The position of the threaded collar 27 defines the position of the elevation cross hair 14. The threaded collar 27 is running on a vertical threaded shaft 28, where the threaded shaft 28 is disposed along a vertical axis and is rotatably supported in the bottom bar 46 and in the top bar 36. The threaded shaft 28 carries only the threaded collar 27 with the elevation cross hair 14. The threaded shaft 28 is held in alignment by the nylon bushings 66, 96 located in the sight window on the side of the second side wall 2,5 and supported in the right side of the top bar 36 and in the right side of the bottom bar 46. The lower part of the threaded shaft 28 is then secured by a retaining nut 17 (FIG. 3). A rotation of the threaded shaft 28 will cause an upward or downward motion of the threaded collar 27 and of the elevation cross hair 14 because the threaded collar 27 with the attached elevation cross hair 14 is retained by the cross hair guide 18 in a defined position with respect to a rotation of the threaded shaft 28, where the defined position of the threaded collar 27 does not rotate around the threaded shaft 28 because of the restraint exerted by the cross hair guide 18 on the elevation cross hair 14. The cross hair guide 18 located inside the first side wall 16 of the sight frame allows the cross hair 14 to ride smoothly within the boundaries defined by the cross hair guide 18.

The threaded shaft 28 is furnished with a shaft pulley 22 at the end of the vertical threaded shaft 28 passing through an opening 58 in the top bar 36. The nylon bushing 96 can be mounted to the top bar 36 in order to provide a low friction feed-through in the top bar 36. The threaded shaft 28 can be retained in the bottom bar 46 with the nylon bushing 66 and such nylon bushing 66 can be retained in the bottom bar 46 by the retaining nut 17 (FIG. 3). A motor support bar 76 can be attached to the second side wall 26. The motor support bar 76 can serve to support a motor 13. The electric motor 13 is connected to the threaded collar 27. The threaded collar 27 is located inside the sight frame and is driven by a motor pulley 12, a shaft pulley 22, and a drive belt 21. The elevation cross hair 14 is raised and lowered as the threaded shaft 28 turns. A microswitch 19 is located in a switch support bar 55 that extends downward from an extension bracket 33 and activates the motor 13. A 1.5 volt power supply is contained in a battery compartment 10 disposed parallel to and underneath the switch support bracket 55.

The motor support bar 76 and the motor shaft 77 of the motor 13 are disposed parallel to the threaded shaft 28. The motor pulley 12 can be attached to the motor shaft 77 of the motor 13 and can be connected to a shaft pulley 22 by a drive. Preferably, the drive is formed by a drive belt 21 for the increased precision of a rotary shaft motion. Preferably, the drive belt 21 as well as the motor pulley 12 and the shaft pulley 22 are covered by a separate protective cover 86.

If desired, the top bar 36 can extend to the outer end 83 of the motor 13, thereby covering a substantial part of the motor 13 and allowing for a fitting of the motor shaft 77 and of the threaded shaft 28 through the top bar 36.

The motor support bar 76 preferably extends parallel to the second side wall 26 and is attached to the second side wall 26 at the outside of the U shape of the second side wall 26.

An extension bracket 33 extending in a direction substantially perpendicular to the sight frame is attached to the motor support bar 76. The sight frame and all of its components are attached to the motor support bar 76 and to the extension bracket 33. This extension bracket 33 extends and places the position of the sight device forwardly approximately from about 5 to 20 centimeters, and preferably from about 10 to 15 centimeters, such as 12.5 centimeters in a forward direction from the front position of the bow. This forward extension assures to an archer a clear view of the sight frame and of the cross hairs.

A mounting bracket 15 can be attached at the end of the extension bracket 33. The mounting bracket 15 is to provide an immediate attachment of the extension bracket 33 and thereby of the bow sight device to a bow.

In addition, a switch support bar 55 can be provided. The switch support bar 55 is preferably attached to the extension bracket 33. The extension bracket 33 extends at the level of about the middle of the motor support bar 76, in a horizontal direction, and the switch support bar 55 extends from the extension bracket 33. However, for purposes of convenience, an angle of from about 45 to 80 degrees is formed between the switch support bar 55 and the extension bracket 33 such that the switch support bar 55 extends forwardly as seen from the attachment point of the switch support bar 55 at the extension bracket 33. The microswitch 19 is mounted near the lower end of the switch support bar 55. The microswitch 19 can be disposed 0.03 to 0.3 times the length of the switch support bar 55 away from the lower end of the switch support bar 55. The microswitch 19 preferably allows at least three positions, i.e., a neutral position where the motor 13 is switched off and not active, a forward position where the motor 13 drives the elevation cross hair 14 into an upper direction, and a reverse position where the motor 13 drives the elevation cross hair 14 in a downward direction. The motion of the switch lever is preferably restrained to a plane disposed perpendicular to an axis of the switch support bar 55.

If desired, the microswitch 19 can be provided such that not only the motor direction can be specified but that also the speed of the motor 13 can be specified such as to provide e.g. for two different speeds of the sight adjustment of the elevation cross hair 14. For example, a motor can be direct or a motor can operate at two speeds, where the second speed is from about 4 to 20 times faster than the first speed. The position of such microswitch 19 with two speeds allows for a faster and more precise positioning of the elevation cross hair 14. A battery is disposed in a battery compartment 10 mounted to the switch support bar 55.

The diameter of the motor pulley 12 is preferably from about 0.5 to 2 times size of the arms of the U of the first side wall 16 and of the second side wall 26.

The diameter of the shaft pulley 22 can be from about 2 to 5 times the diameter of the motor pulley 12.

The mode of operation of the invention sight device is as follows:

The sight device is initially calibrated by first establishing a geographical location of a center position for the target. The archer will shoot a few arrows at a target. In case these arrows are hitting to the left of the target, the archer will move the vertical cross hair 25 by adjustment to the left of the target and, in case these arrows are hitting to the right of the target, the archer will move the vertical cross hair 25 by adjustment to the right of the target. When he is satisfied that he has established the center of the target as determined by the vertical cross hair 25, then the adjustment collar 23 is locked in place by tightening the set screw 43 on the adjustment collar 23. Once this is done, the vertical cross hair 25 is held stationary in this position and will not have to be moved again.

The next step is to adjust the distance yardage. A stripe of white tape is placed on a part 20 of the first side wall 16, facing the archer, at the left side of the sight window. This tape will be used to mark the various distances. The archer will then measure a distance of 20 yards to the target. Then, a few arrows are shot at the target. If the arrows are hitting at a point lower than anticipated, then the elevation cross hair 14 is lowered by pushing the microswitch 19 for moving the elevation cross hair 14. In case the arrows are hitting a point higher than expected according to the sight device, then the elevation cross hair 14 is raised. When the archer is satisfied that he has established to hit the exact dead center of the target, then a mark is placed on the white tape, where this mark represents the 20 yard mark. This process is repeated for all of the various distances and yardage lengths the archer selects.

The sight device of the present invention gives the archer an ability to adjust the sight quickly and quietly throughout the full spectrum of usable range. The accuracy achievable with the invention sight device can be attributed to the sight window which frames the target and the convergence of the cross hairs 14, 25 that provide a dead center reference point.

It will be understood that each of the elements described above, or two or more together, may also find a useful application in other types of sight devices differing from the types described above.

While the invention has been illustrated and described as embodied in the context of a sight device for an archery bow, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A bow sight device including a rectangular frame;

a horizontally disposed, vertical-adjustment shaft disposed at a first horizontal side of the rectangular frame;

a horizontal retaining channel disposed inside the rectangular frame and running parallel to and at a second horizontal side of the rectangular frame;

a vertical cross hair retained by the horizontal retaining channel and attached to a support element mounted at the vertical-adjustment shaft for the vertical cross hair;

a first vertical side of the rectangular frame;

a vertical cross hair guide disposed inside the rectangular frame and running parallel to and at the first vertical side of the rectangular frame;

a threaded shaft disposed near a second vertical side of the rectangular frame, wherein the first horizontal side of the rectangular frame supports a first side of the threaded shaft, and wherein the second horizontal side of the rectangular frame supports a second side of the threaded shaft;

a shaft pulley mounted to the threaded shaft outside the rectangular frame;

a motor including a motor shaft and attached to the rectangular frame and having an axis parallel to the axis of the threaded shaft;

a motor pulley mounted on the motor shaft;

a drive belt connecting the motor pulley and the shaft pulley;

a threaded collar attached to the threaded shaft;

a horizontal elevation cross hair having a first end attached to the threaded collar and having a second end free and guided by the vertical cross hair guide.

2. The bow sight device according to claim 1, further comprising a motor support bar attached to the rectangular frame and supporting the motor;

a protective cover attached to the rectangular frame and covering the motor pulley, the shaft pulley, and the drive belt;

an extension bracket attached to the motor support bar;

a switch support bar attached to the extension bracket;

an electrical switch mounted on the switch support bar;

a battery disposed in a battery compartment, wherein the battery compartment is attached to the switch support bar, and wherein the battery is connected to the electrical switch for feeding electrical power to the motor upon actuation of the electrical switch.

3. The bow sight device according to claim 2, further comprising an electrical line connecting the battery to the motor.

4. The bow sight device according to claim 2, wherein the vertical cross hair is disposed at a close distance behind the horizontal elevation cross hair toward an operator of the bow, and wherein a positioning of the vertical cross hair and of the horizontal elevation cross hair form an intersection point within the rectangular frame, wherein the positioning of the vertical cross hair is manually adjustable, and wherein the positioning of the horizontal elevation cross hair is adjustable with a moving of the shaft pulley upon actuation of the electrical switch.

5. The bow sight device according to claim 1, wherein the vertical cross hair and the horizontal elevation cross hair are in each case formed by a thin wire which is rigid enough to retain a straight direction.

6. The bow sight device according to claim 1, wherein the rectangular frame forms a sight window, and wherein the first horizontal side and the second horizontal side of the sight window are in each case formed by angle irons, and wherein the first vertical side and the second vertical side are in each case formed by U profiles.

7. The bow sight device according to claim 6, wherein the horizontal retaining channel and the vertical cross hair guide are in each case formed by a U profile of a smaller size than the U profiles forming the first vertical side and the second vertical side.

8. The bow sight device according to claim 6, wherein the sight window is disposed at such a distance from a bow as to allow a most precise and steady shooting of an arrow to a target.

9. The bow sight device according to claim 8, wherein the distance from the sight window to the bow is from 5 to 10 inches.

10. The bow sight device according to claim 8, wherein the distance from the sight window to the bow is from 7 to 8 inches.

11. The bow sight device according to claim 1, further comprising a mounting bracket detachably fixed with a butterfly screw at the extension bracket.

12. A bow sight device including a rectangular frame;

a horizontally disposed, vertical-adjustment shaft disposed at a first horizontal side of the rectangular frame;

a horizontal retaining channel disposed inside the rectangular frame and running parallel to and at a second horizontal side of the rectangular frame;

a vertical cross hair retained by the horizontal retaining channel and attached to a support element mounted at the vertical-adjustment shaft for the vertical cross hair;

a first vertical side of the rectangular frame;

a vertical cross hair guide disposed inside the rectangular frame and running parallel to and at the first vertical side of the rectangular frame;

a threaded shaft disposed near a second vertical side of the rectangular frame, wherein the first horizontal side of the rectangular frame supports a first side of the threaded shaft, and wherein the second horizontal side of the rectangular frame supports a second side of the threaded shaft;

a shaft pulley mounted to the threaded shaft outside the rectangular frame;

a motor including a motor shaft and attached to the rectangular frame and having an axis parallel to the axis of the threaded shaft;

a motor pulley mounted on the motor shaft;

a drive belt connecting the motor pulley and the shaft pulley;

a threaded collar attached to the threaded shaft;

a horizontal elevation cross hair attached to the threaded collar and retained by the vertical cross hair guide;

a motor support bar attached to the rectangular frame and supporting the motor;

a protective cover attached to the rectangular frame and covering the motor pulley, the shaft pulley, and the drive belt;

an extension bracket attached to the motor support bar;

a switch support bar attached to the extension bracket;

an electrical switch mounted on the switch support bar;

a battery disposed in a battery compartment, wherein the battery compartment is attached to the switch support bar, and wherein the battery is connected to the electrical switch for feeding electrical power to the motor upon actuation of the electrical switch, and wherein the motor causes a clockwise and a counterclockwise rotation of the motor shaft depending on a position of the electrical switch, and wherein the motor is a two-speed motor.

13. The bow sight device according to claim 1, further comprising a nylon bushing disposed at the first side of the threaded shaft;

a nylon bushing disposed at the second side of the threaded shaft;

a retaining nut fixedly securing the second side of the threaded shaft to the second horizontal side of the rectangular frame.

14. The bow sight device according to claim 2, wherein a distance between the motor support bar and the second vertical side of the rectangular frame is from about ¼ inch to ½ inch.

15. A bow sight device including a rectangular frame having a first vertical side wall, a second vertical side wall, a top side wall, and a bottom side wall;

a horizontally disposed, vertical-adjustment shaft disposed neighboring the top side wall of the rectangular frame;

a horizontal retaining channel disposed inside the rectangular frame and running parallel to and at the bottom side wall of the rectangular frame;

a threaded shaft having a top end and a bottom end, wherein the top end is supported by the top side wall, and wherein the bottom end is supported by the bottom side wall;

an adjustment collar rotatably mounted at the vertical-adjustment shaft;

a vertical cross hair retained by the retaining channel and attached to the adjustment collar mounted at the horizontally disposed vertical-adjustment shaft for the vertical cross hair;

a shaft pulley mounted to the threaded shaft outside the top side wall of the rectangular frame;

a motor including a motor shaft and attached to the rectangular frame and having an axis parallel to an axis of the threaded shaft;

a motor pulley mounted on the motor shaft;

a drive belt connecting the motor pulley and the shaft pulley;

a threaded collar attached to the threaded shaft;

a vertical cross hair guide disposed inside the rectangular frame and running parallel to and at the first vertical side of the rectangular frame;

a horizontal elevation cross hair having a first end attached to the threaded collar and having a second end free and guided by the vertical cross hair guide.

16. A method for calibrating a bow sight device, where the bow sight device includes a rectangular frame;

a horizontally disposed, vertical-adjustment shaft disposed at a first horizontal side of the rectangular frame;

a horizontal retaining channel disposed inside the rectangular frame and running parallel to and at a second horizontal side of the rectangular frame;

a vertical cross hair retained by the horizontal retaining channel and attached to a support element mounted at the horizontally disposed adjustment shaft for the vertical cross hair;

a first vertical side of the rectangular frame;

a vertical cross hair guide disposed inside the rectangular frame and running parallel to and at the first vertical side of the rectangular frame;

a threaded shaft disposed near a second vertical side of the rectangular frame, wherein the first horizontal side of the rectangular frame supports a first side of the threaded shaft, and wherein the second horizontal side part of the rectangular frame supports a second side of the threaded shaft;

a shaft pulley mounted to the threaded shaft outside the rectangular frame;

a motor including a motor shaft and attached to the rectangular frame and having an axis parallel to the axis of the threaded shaft;

a motor pulley mounted on the motor shaft;

a drive belt connecting the motor pulley and the shaft pulley;

a threaded collar attached to the threaded shaft;

a horizontal elevation cross hair having a first end attached to the threaded collar and having a second end free and guided by the vertical cross hair guide;

including the steps for establishing a geographical location of a center position for a target by shooting a few arrows at a target;

determining that these arrows are hitting to the left of the target and subsequently moving the vertical cross hair in the bow sight device by adjustment to the left;

determining that these arrows are hitting to the right of the target and subsequently moving the vertical hair in the bow sight device by adjustment to the right;

locking an adjustment collar retaining the vertical cross hair once the center of the target as determined by the vertical cross-hair is established;

tightening a screw at the adjustment collar to hold the vertical cross hair stationary in its position;

adjusting the distance yardage by placing a stripe of white tape on the left side of the sight window, wherein this tape will be used to mark the various distances;

measuring a defined distance to the target;

shooting a plurality of arrows at the target;

determining if the arrows are hitting at a point lower than anticipated and subsequently lowering the horizontal cross hair by pushing the switch for moving the horizontal cross hair;

determining if the arrows are hitting at a point higher than anticipated and subsequently raising the horizontal cross hair by pushing the switch for moving the horizontal cross hair;

determining that the arrows hit an exact dead center of the target;

placing a mark on the white tape, where this mark represents a defined mark;

repeating the steps for adjusting the distance yardage for various distances selected.

17. The method for calibrating a bow sight device according claim 16, wherein the sight is adjustable quickly and quietly throughout the full spectrum of usable range with the sight device including the sight window, wherein the sight window frames the target and the convergence of the cross hairs to provide a dead center reference point.

* * * * *